US011007624B2

(12) United States Patent
Wong

(10) Patent No.: US 11,007,624 B2
(45) Date of Patent: May 18, 2021

(54) MAGNETIC CLAMPING TOOL

(71) Applicant: Harry Wong, South Pasadena, CA (US)

(72) Inventor: Harry Wong, South Pasadena, CA (US)

( * ) Notice: Subject to any disclaimer, the term of this patent is extended or adjusted under 35 U.S.C. 154(b) by 243 days.

(21) Appl. No.: 16/355,537

(22) Filed: Mar. 15, 2019

(65) Prior Publication Data

US 2020/0290177 A1 Sep. 17, 2020

(51) Int. Cl.
*B25B 11/00* (2006.01)

(52) U.S. Cl.
CPC ..... *B25B 11/002* (2013.01)

(58) Field of Classification Search
CPC .. B25B 3/00; B25B 5/00; B25B 11/00; B25B 11/002; B25B 11/02; B23Q 3/06; B23Q 3/066; B23Q 3/082
See application file for complete search history.

(56) References Cited

U.S. PATENT DOCUMENTS 3,924,844 A * 12/1975 Bachtel, Jr. ..... B25B 5/12 269/94
4,253,649 A * 3/1981 Hewson ..... B25B 1/22 269/45
9,505,089 B1 11/2016 Wong
9,757,842 B2 * 9/2017 Huelsmann ..... E05C 19/14
2007/0102859 A1 * 5/2007 Hagan ..... B25B 5/12 269/228
2007/0108684 A1 * 5/2007 Webb ..... B25B 5/163 269/228
2007/0284795 A1 * 12/2007 Lancaster-Larocque ..... B25B 5/04 269/8
2014/0208898 A1 * 7/2014 Lesche ..... B25B 7/123 81/423
2020/0290177 A1 * 9/2020 Wong ..... B25B 11/002

* cited by examiner

*Primary Examiner* — Lee D Wilson
(74) *Attorney, Agent, or Firm* — Jen-Feng Lee, Esq.

(57) ABSTRACT

Present invention disclosed and claimed a magnetic clamping tool where a clamping arm with a clamping finger serves to clamp on a working object in normal, sideways, or even up-side-down orientations, where the movements of the clamping finger is controlled by a first wing screw and the movement of the clamping arm is controlled by a third wing screw. The clamping arm is releasably attached to a bracket which is further releasably attached to a V-pad by a locking nut. An anti-tipping screw provides a counter-balancing force to the biasing force of a helical spring on the bracket, and is most useful when the longitudinal direction of the bracket is at a 90-degree angle with the longitudinal direction of the clamping arm.

5 Claims, 6 Drawing Sheets

MAGNETIC CLAMPING TOOL

FIELD AND BACKGROUND OF THE INVENTION

The invention relates to a magnetic clamping tool that is useful for welding operation where clamping to a metal, or magnetic work piece, is needed. The clamping tool can be used in a normal (right-side-up), up-side-down, or sideways/vertical orientations. The height-adjustable clamping arm provides great flexibility for application on different types of work pieces, having different types of contact surfaces.

SUMMARY OF THE INVENTION

The invention relates to a magnetic clamping tool that has a spring loaded bracket slidably attached to a V-pad, allowing for the use of the magnetic clamping tool in a normal right-side up, or upside-down, sideways or vertical orientations.

The V-pad has two legs that end with a swivel metal plate respectively. A plurality of magnets are embedded in and flush with the flat surface of the metal plate. In real world application, such magnets can be made to be replaceable. Also, depending on the size and magnetic power of the magnet, at least one magnet would suffice if the single magnet is of substantial and enough magnetic power. It is believed, however, that using two, or more, magnets may provide more balanced grasping power, and a sort of back-up, in the case where one magnet appears to lose its power.

The legs have swivel metal plates that allow pivoting around for attached to different surfaces, including angled or round surfaces.

A movable clamping arm is slidably connected to said bracket, using a third wing screw as the controlling mechanism. As such, by loosening the third wing screw, the clamping arm can be moved, slidingly, relative to the bracket, to a designed length, at a designed point.

The bracket has the capability to rotate 360 degrees relative to the V-pad, and is done by a locking nut mechanism.

The movable clamping arm has a hole at a distal end of the arm. A clamping finger is slidably connected within the hole. The clamping finger is rotatable and slidable relative to the movable clamping arm where a first wing screw controls the clamping finger's movement within said hole, either for rotation or up-down sliding.

The slidable and height-adjustable clamping finger makes the present invention suitable for clamping work pieces of different thickness. The swiveled clamping jaw provides better contact on the surface of work pieces having variable shapes.

A helical spring, placed at a pivoting joint of the bracket, provide the biasing force to push the clamping finger towards a work piece, where the clamping jaw will be contacting the work piece. An anti-tipping screw provides a counter-balancing force to the biasing force of the helical spring.

Ground wires are provided to facilitate electrical grounding when clamping on to welding objects with electric-welding or arc-welding.

DESCRIPTION OF THE DRAWINGS

The accompanying drawings, which are incorporated in and constitute a part of this specification, illustrate and exemplify the preferred embodiments of the invention. Together with the description, serve to explain the principles of the invention.

A brief description of the drawings is as follows.

DETAILED DESCRIPTION OF THE PREFERRED EMBODIMENT

Figure 1:
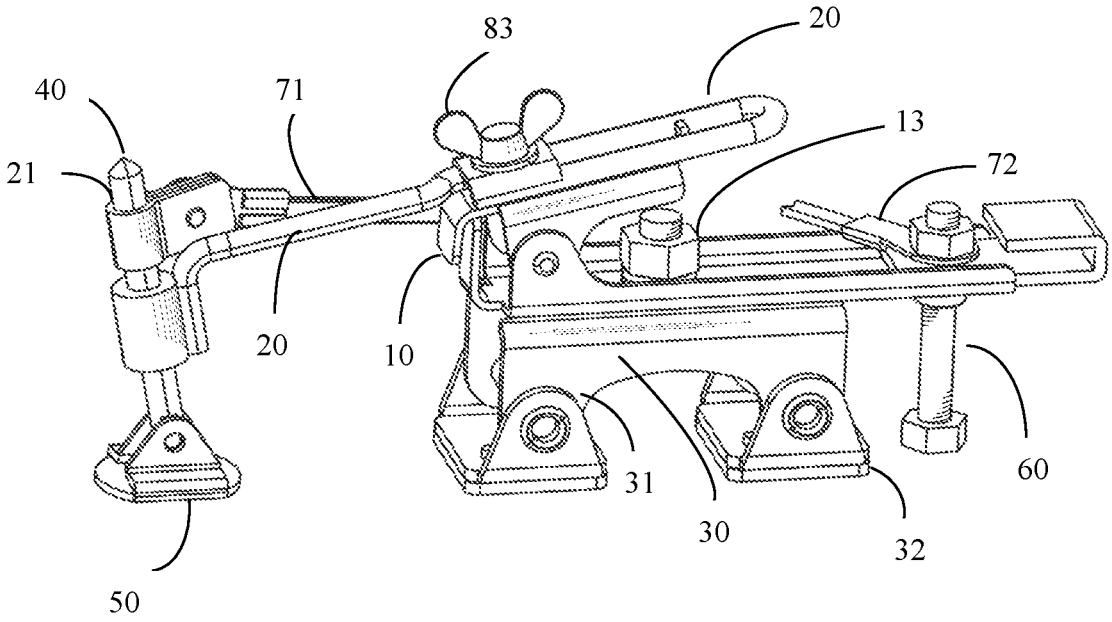
FIG. 1 shows perspective view of the present invention.
Figure 2:
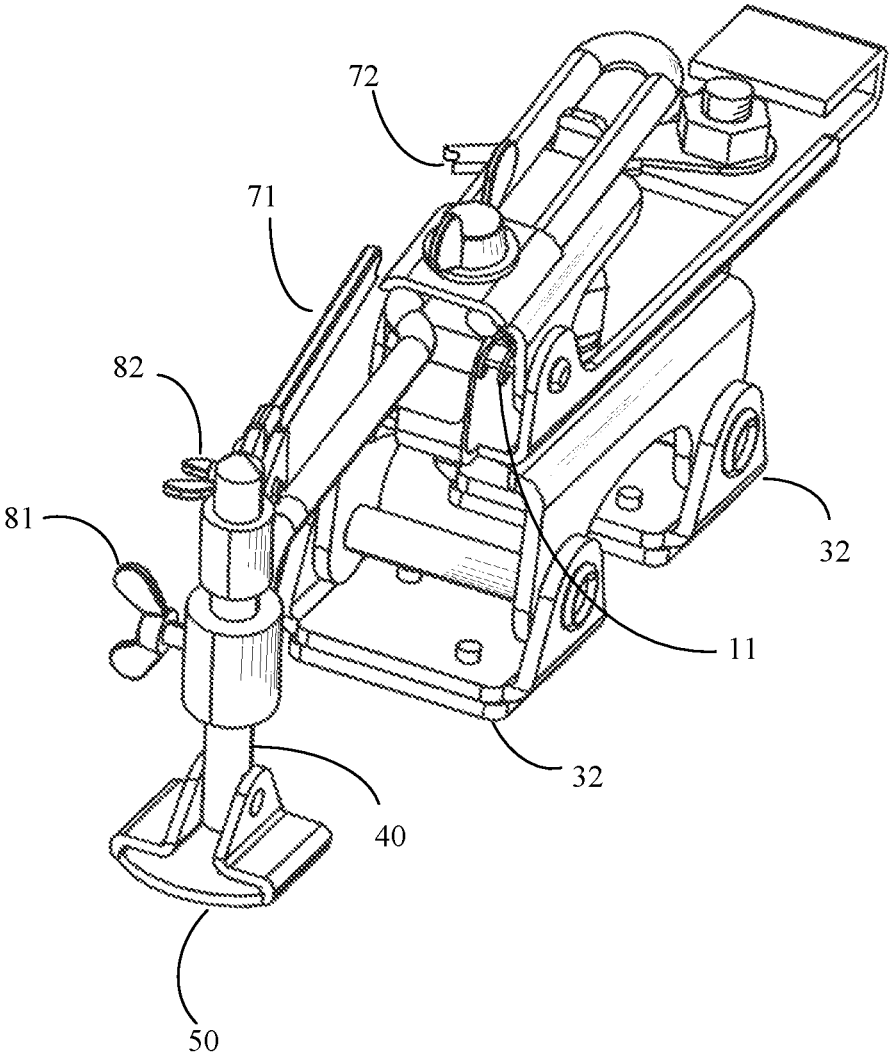
FIG. 2 shows another perspective new of the present invention.

As shown by FIGS. 1-2, the present invention of a magnetic clamping tool is comprised of a spring loaded bracket 10, which is slidably mounted to a V-pad 30. Said V-pad 30 has two legs 31 that end with a swivel metal plate 32 respectively.

Figure 3:
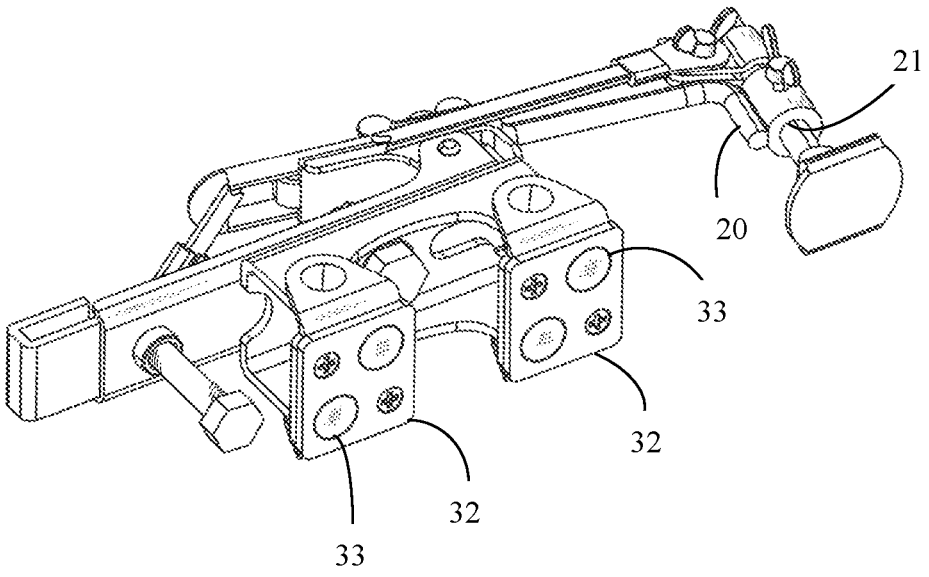
FIG. 3 shows a bottom view of the present invention.

A plurality of magnets 33 are embedded in and flush with the flat surface of the metal plate 32, as shown in FIG. 3. Depending on the size and magnetic power of the magnet 33, at least one magnet 33 would suffice if the single magnet 33 is of substantial and enough magnetic power. It is believed, however, that using two, or more, magnets 33 may provide more balanced grasping power, and a sort of back-up, in the case where one magnet appears to lose its power.

The metal plates 32 are fastened to the legs via simple mechanism of one or more screws.

A movable clamping arm 20 is slidably connected to said bracket 10, using a third wing screw 83 as the controlling mechanism. The clamping arm 20 is slidable over the bracket 10 by loosening the third wing screw 83 so that the effective length of the clamping arm 20 (hence the clamping force) is adjustable.

The movable clamping arm 20 has a hole 21 at a distal end of the arm 20. A clamping finger 40 is slidably connected within the hole 21. The clamping finger 40 is rotatable and slidable relative to the movable clamping arm 20 where a first wing screw 81 controls the clamping finger's 40 movement within said hole 21, either for rotation or up-down sliding adjustment.

The clamping finger 40 has a swiveled clamping jaw 50 at a distal end.

The slidable clamping finger 40 makes the present invention suitable for clamping work pieces of different thickness. The swiveled clamping jaw 50 provides better contact on the surface of work pieces having variable shapes.

The spring loaded bracket 10 further has an anti-tipping screw 60. A helical spring 11, shown in FIG. 2, provides the biasing force to push the clamping finger 40 towards a work piece, where the clamping jaw 50 will be contacting the work piece. The anti-tipping screw 60 provides a counter-balancing force to the biasing force of the helical spring 11.

Figure 4:
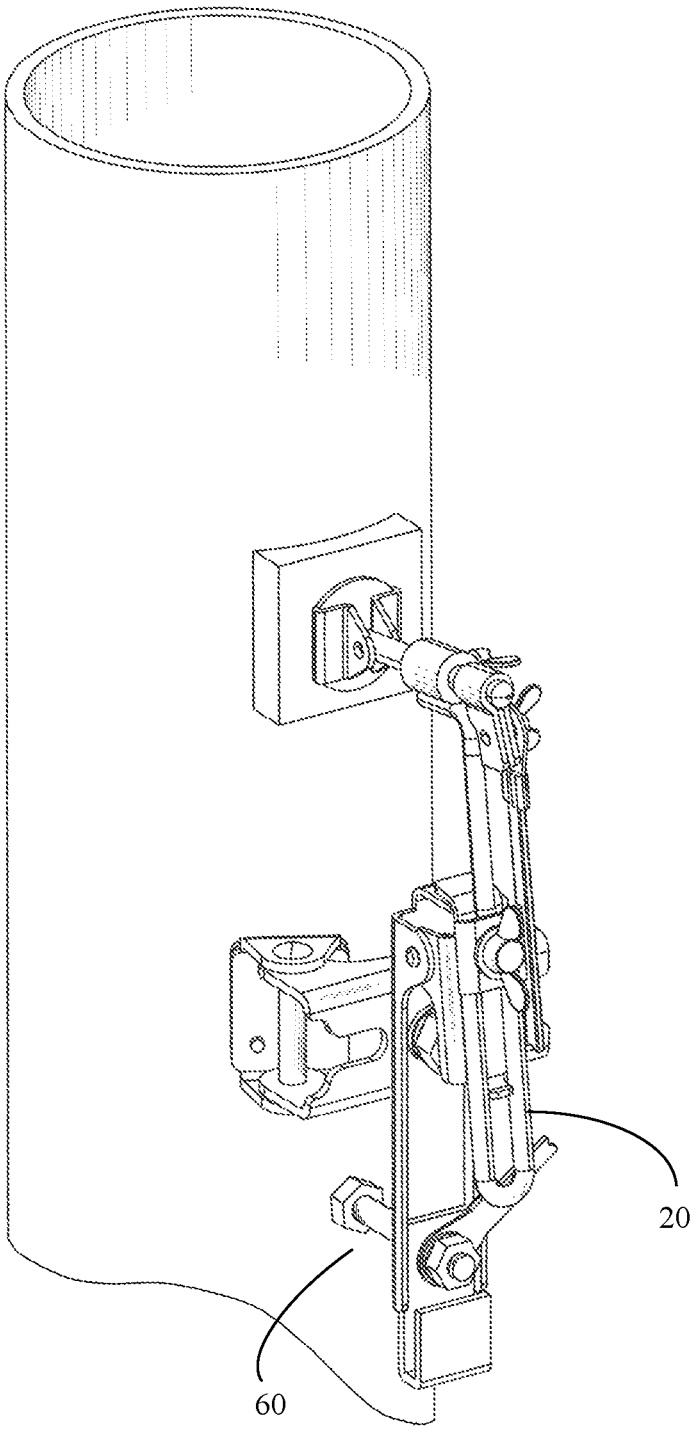
FIG. 4 shows the application of present invention used on a cylindrical work piece, in a sideways orientation (vertically clamping the objects).

The anti-tipping screw 60 is most useful when the longitudinal direction of the bracket 10 is at a 90-degree angle with the longitudinal direction of the clamping arm 20, such as the application shown in FIG. 4. When the bracket 10 and the clamping arm 20 have their longitudinal direction lined up, the two legs 31 generally will provide sufficient stabilizing force, though the anti-tipping screw 60 no doubt adds to the stability.

A first ground wire 71 is attached to the clamping finger 40 via a second wing screw 82. A second ground wire 72 is attached to the anti-tipping screw 60.

The spring loaded bracket 10 is releasably attached to the V-pad by a locking nut 13, so that the bracket 10 is 360-degree rotatable relative to the V-pad 30, and allowing the present invention to be used in various applications.

The swivel metal plates 32 provide good contact with work pieces of various shapes, including flat, cylindrical, angled, and even irregular.

FIG. 4 shows the clamping tool of present invention is clamping onto a cylindrical work piece where the clamping tool is in a vertically oriented position. The bracket 10 is turned at a 90-degree angle relative to the V-pad 30, with the two swivel metal plates 32 sticking to the round surface of the cylindrical work piece.

Figure 5:
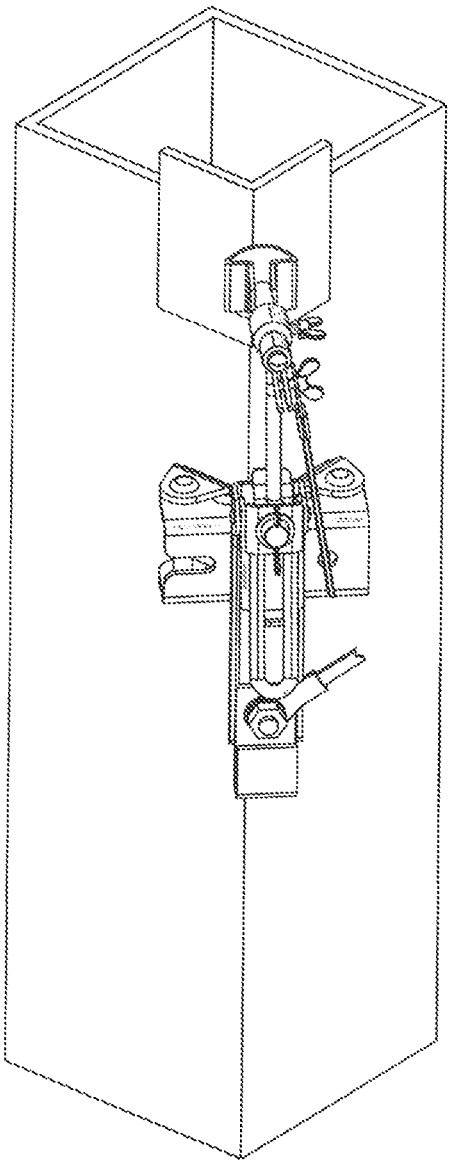
FIG. 5 shows the application of present invention used on a square tube work piece, in a sideways orientation.

FIG. 5 shows the clamping tool of present invention is clamping onto a square tube, with the clamping jaw 50 clamping an angled work piece to the square tube.

Figure 6:
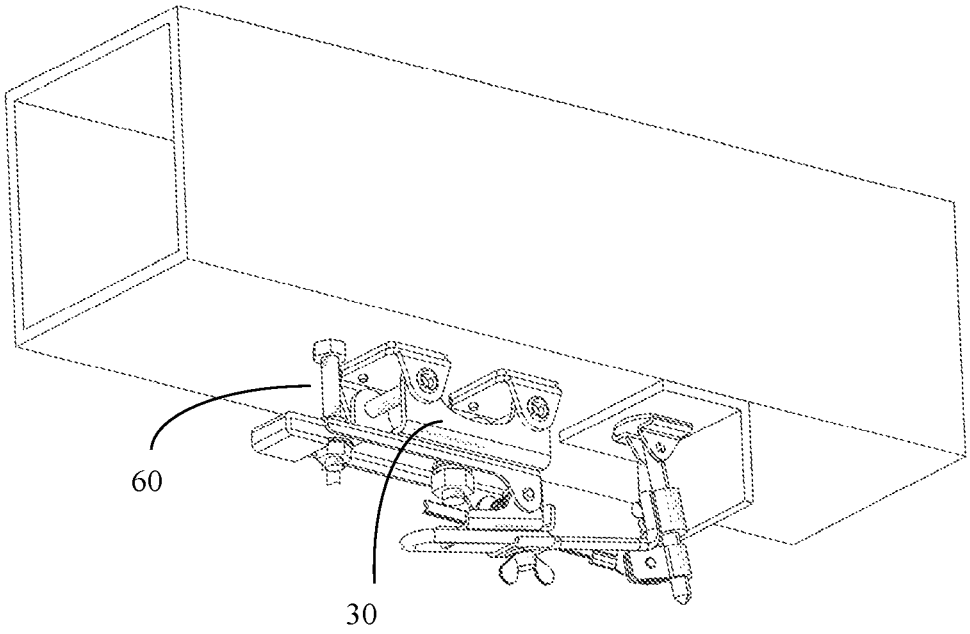
FIG. 6 shows the application of present invention used on the underside of a work piece, in an up-side-down orientation.

FIG. 6 shows the clamping tool of present invention is clamping onto the underside of a square tube.

There is no limitation as to the size of the magnets 33, which can be made to replaceable as well.

As can be seen, present invention can be used on flat, round, angled and irregular surfaces of various work pieces. The height-adjustable, length-adjustable, 360-degree and rotatable clamping arm-and-finger configuration provides tremendous flexibility for the use of present magnetic clamping tool as disclosed herein.

What is claimed is:

1. A magnetic clamping tool, comprising:

a spring-loaded bracket;

a V-pad further having two legs, each of the two legs is equipped with a swivel metal plate, wherein each of said metal plate contains a plurality of magnets;

a movable clamping arm having a clamping finger slidably connected within a hole near a distal end of said clamping arm, said clamping finger is equipped with a swiveled clamping jaw; and first wing screw, second wind screw and third wing screw.

2. The magnetic clamping tool of claim 1 wherein said bracket further having an anti-tipping screw.

3. The magnetic clamping tool of claim 2 wherein the bracket is releasably attached to the V-pad by a locking nut.

4. The magnetic clamping tool of claim 3 wherein said first wing screw controls the clamping finger's sliding movement within said hole, said second wing screw controls an optional first ground wire, and said third wing screw controls the movement of said clamping arm relative to the bracket.

5. The magnetic clamping tool of claim 3 wherein an optional second ground wire is attached to the anti-tipping screw.

* * * * *